US006400087B2

(12) United States Patent
van den Nieuwenhuizen et al.

(10) Patent No.: US 6,400,087 B2
(45) Date of Patent: Jun. 4, 2002

(54) UNIT COMPRISING A HIGH-PRESSURE DISCHARGE LAMP AND AN IGNITION ANTENNA

(75) Inventors: Hubertus Cornelis Maria van den Nieuwenhuizen, Eindhoven (NL); Johannes Martinus De Regt, Stuttgart (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/778,262

(22) Filed: Feb. 7, 2001

(30) Foreign Application Priority Data

Feb. 11, 2000 (EP) ..... 00200447

(51) Int. Cl.[7] ..... H01J 7/44

(52) U.S. Cl. ..... 315/73; 315/60; 313/594; 313/635

(58) Field of Search ..... 315/59, 60, 73; 313/198, 113, 201, 635, 594

(56) References Cited

U.S. PATENT DOCUMENTS 4,053,809 A * 10/1977 Fridrich et al. ..... 313/113
4,818,915 A * 4/1989 Zaslavsky et al. ..... 315/150
5,136,204 A * 8/1992 Muzeroll et al. ..... 313/25
5,541,480 A * 7/1996 Renardus et al. ..... 313/594
5,905,338 A * 5/1999 Verspaget et al. ..... 313/318.12
5,959,404 A * 9/1999 Nortrup et al. ..... 313/594
6,172,462 B1 * 1/2001 Gibson et al. ..... 313/594

FOREIGN PATENT DOCUMENTS

WO 9948133 9/1999
WO 0077826 A1 12/2000

* cited by examiner

*Primary Examiner*—Haissa Philogene
(74) *Attorney, Agent, or Firm*—Dicran Halajian

(57) ABSTRACT

A short-arc discharge lamp (1) is provided with a light-transmitting, gastight lamp vessel (10), which is provided with an ionizable filling. A first electrode and a second electrode (11*a*, 11*b*), respectively, are arranged in the lamp vessel (10) and are each connected to a current conductor of their own (12*a*, 12*b*), respectively, which issues from the lamp vessel to the exterior. An ignition antenna (2) is arranged near the lamp vessel, which ignition antenna is connected to a further current conductor (24). The ignition antenna comprises an antenna vessel (20) and a further outer electrode (22), which antenna vessel (20) is closed in a gastight manner and provided with an ionizable filling, the further outer electrode (22) being connected to the further current conductor (24). The antenna encloses an electroconductive element. In this way, very small ignition delays are guaranteed, even if the lamp has been in a dark environment for some time.

9 Claims, 2 Drawing Sheets

UNIT COMPRISING A HIGH-PRESSURE DISCHARGE LAMP AND AN IGNITION ANTENNA

FIELD OF THE INVENTION

The invention relates to a unit comprising a high-pressure discharge lamp and an ignition antenna, which high-pressure discharge lamp is provided with a light-transmitting, gastight lamp vessel containing an ionizable filling, in which lamp vessel a first and a second electrode are arranged, and each one of the electrodes is connected to a current conductor of its own, which issues from the lamp vessel to the exterior, which ignition antenna, which is arranged near the lamp vessel, is provided with a gastight antenna vessel which contains an ionizable filling and which is provided with a further outer electrode, which is provided on an outside surface of the antenna vessel and connected to a further current supply conductor.

BACKGROUND OF THE INVENTION

Such a unit comprising a high-pressure discharge lamp and an ignition antenna is disclosed in 99/48133. The known lamp has a comparatively short discharge arc, enabling light generated by the lamp to be satisfactorily focused. As a result thereof, the lamp can very suitably be used, inter alia, as a projection lamp, for example in a projection system or in a car headlamp system. The known lamp contains a filling, the pressure of which, during operation of the lamp, assumes a very high value of the order of several tens of bars and higher. To improve the ignition behavior of the known lamp, the lamp is provided with an ignition antenna in the form of a vessel filled with an ionizable gas, which vessel is provided with a capacitively coupled electrode. When an ignition voltage is applied to the further current conductor, the further outer electrode causes ionization of the ionizable filling of the antenna vessel. As a result, the filling of the antenna vessel has become conducting, thereby generating an electric field in the lamp vessel. In general, the ignition time is shorter as the ignition voltage applied to the ignition antenna is higher. This applies if the lamp is ignited in the cold state as well as if the lamp is re-ignited shortly after having been turned off, i.e. when the lamp is still hot. It has been found that in spite of the presence of the ignition antenna, a substantial degree of ignition delay may occur, which is a drawback.

SUMMARY OF THE INVENTION

Therefore, it is an object of the invention to provide a measure which, in the case of a unit as described in the opening paragraph, counteracts said drawback. To achieve this, the unit of the type described in the opening paragraph is characterized in accordance with the invention in that the antenna vessel of the ignition antenna also encloses an electroconductive element. Surprisingly, it has been found that ignition delay has substantially disappeared. When an ignition voltage is applied to the further current conductor, the further outer electrode substantially instantaneously brings about ionization of the ionizable filling of the antenna vessel, so that, also substantially instantaneously, like in the case a metal conductor is used for the antenna, an electric field is generated in the lamp vessel. As a result, ignition delay is counteracted, so that the ignition time is reduced.

The measure in accordance with the invention is particularly effective when high-pressure discharge lamps are ignited under unfavorable conditions, for example if the lamp has been in a dark environment for a substantial period of time.

In order to counteract optical losses of light emitted by the lamp, the antenna vessel is preferably made of a translucent material, for example a ceramic material such as monocrystalline metal oxide, for example sapphire, polycrystalline metal oxide, for example translucent, gastight aluminum oxide (DGA), yttrium aluminum garnet (YAG) or yttrium oxide (YOX), or polycrystalline non-oxidic material, such as aluminum nitride (AIN). Glass, for example quartz glass, can also suitably be used as the translucent material and has the additional advantage that it enables a comparatively great design freedom of the ignition antenna.

In the unit in accordance with the invention, the type and intensity of the radiation generated in the antenna vessel for achieving a short hot-state reignition time is not essential. To achieve a short ignition time when the lamp is ignited in the cold state, in the absence of ambient light, it is favorable, however, if the ignition antenna generates, in an activated state, UV radiation, preferably, in a wavelength range from 190 to 260 nm. For this purpose, for example, the ignition antenna contains a filling of mercury and argon.

As the further outer electrode is provided on the outside surface of the antenna vessel, a gastight lead-through to the electroconductive element enclosed in the antenna vessel is not necessary. In addition, this leads to an increased choice regarding the materials that can be used for the further electrode, because, in this case, the wall of the antenna vessel precludes any chemical interactions between the further electrode, the conductive element and the filling.

The ignition voltage applied to the ignition antenna is, for example, a high-frequency AC voltage, but it may alternatively be a pulse-shaped voltage, which may or may not be repetitive.

In a favorable embodiment, the unit in accordance with the invention is further characterized in that the electroconductive element is situated inside the antenna vessel at the location of the further outer electrode. If the antenna vessel comprises an elongated part along which the further electrode extends, it is attractive for the electroconductive element to extend at least 2 mm beyond the further electrode. In this case, an instantaneous ionization in the antenna vessel is guaranteed upon applying an ignition voltage to the further electrode.

An attractive embodiment of the unit in accordance with the invention is characterized in that the lamp vessel comprises a comparatively wide central portion and, on either side thereof, neck-shaped end portions, the electrodes being arranged in the central portion of the lamp vessel, and the current conductors each extending through a respective end portion, and the antenna vessel of the ignition antenna being a tube which is bent, near the central portion, around one of the end portions. This two-sided, high-pressure discharge lamp can be readily mass-produced on an industrial scale.

Preferably, the lamp forms part of a projection system, and the unit is provided with a reflector. A practical, compact embodiment of such a unit is characterized in that the reflector is a converging reflector with an optical axis, a light emission opening and, opposite said opening, a further opening, the reflector surrounding the central portion of the lamp vessel, the neck-shaped portions of the lamp vessel extending along the optical axis, and the end portion, around which the ignition antenna is bent, issuing to the exterior through said further opening.

These and other aspects of the invention will be apparent from and elucidated with reference to the embodiment(s) described hereinafter.

DETAILED DESCRIPTION OF THE INVENTION

Figure 1:
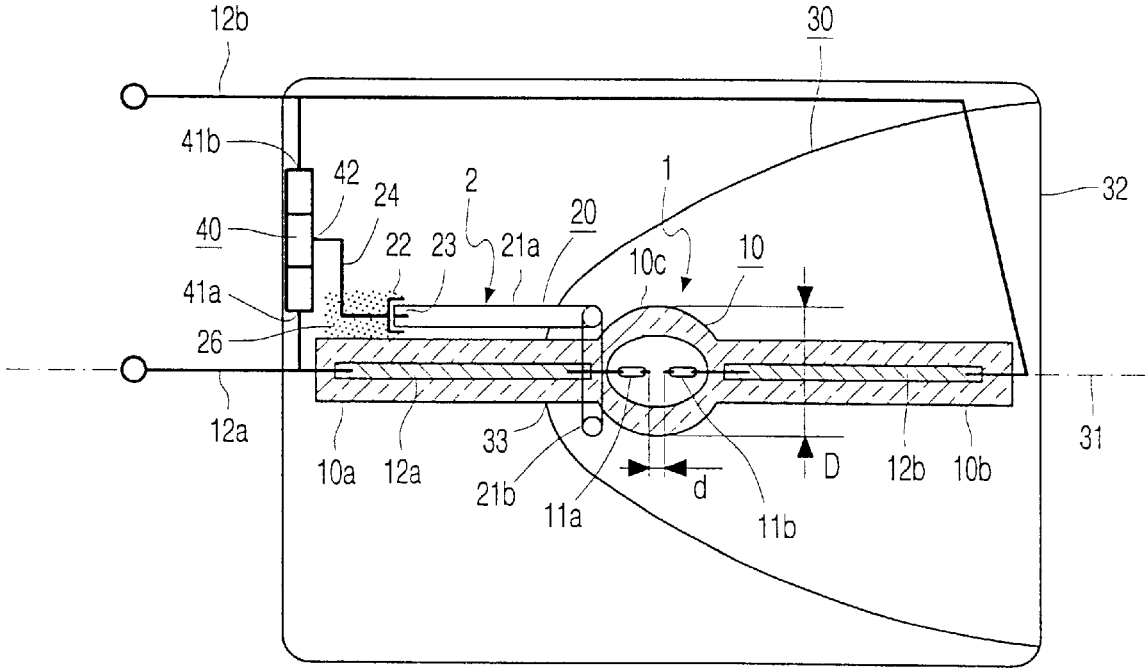
FIG. 1 is a longitudinal sectional view of a first embodiment of a unit comprising a high-pressure discharge lamp and an ignition antenna in accordance with the invention, wherein the unit additionally comprises a reflector.

FIG. 1 shows a unit comprising a high-pressure discharge lamp 1 and an ignition antenna 2. The high-pressure discharge lamp is provided with a light-transmitting, gastight lamp vessel 10 containing an ionizable filling. In this case, the filling contains one or more inert gases, here argon at a filling pressure of 100 mbar, at least 0.2 mg/mm$^3$ mercury and for example $10^{-6}$–$10^{-4}$ $\mu$mol/mm$^3$ of one or more of the halides Cl, Br, I, here in the form of mercury bromide. In FIG. 1, the lamp vessel is made of quartz glass, but it may alternatively be made of a ceramic material. A first and a second electrode 11*a*, 11*b* are arranged in the lamp vessel 10, the interspace d between the electrodes being 1 mm. The lamp vessel 10 has a largest outside diameter D of 9 mm. Each one of the electrodes 11*a*, 11*b* is connected to a current conductor of its own 12*a*, 12*b*, respectively, which issues from the lamp vessel 10 to the exterior. The ignition antenna 2 arranged near the lamp vessel 10 is connected to a further current conductor 24. Arcing of the further current conductor 24 to the neck-shaped portion 10*a* is precluded with a cement 26 on the basis of a ceramic material, which is provided for insulation purposes.

In the embodiment shown in FIG. 1, the lamp vessel 10 of the high-pressure discharge lamp comprises a comparatively wide central portion 10*c* and, on either side thereof, neck-shaped end portions 10*a*, 10*b* having an outside diameter of 6.1 mm. The electrodes 11*a*, 11*b* are arranged in the central portion 10*c* of the lamp vessel 10, and the current conductors 12*a*, 12*b* each extend through an end portion 10*a*, 10*b*, respectively.

Figure 2A:
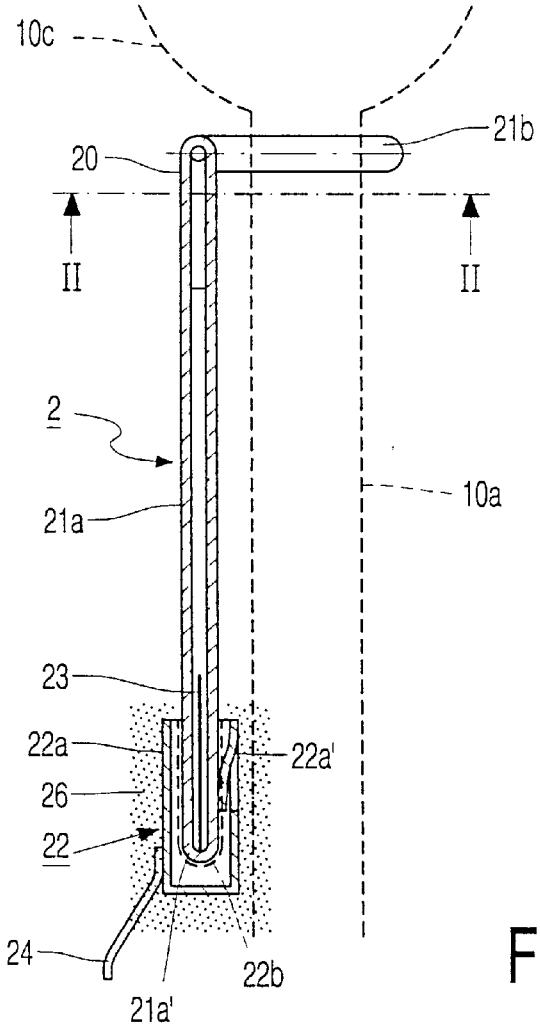
FIG. 2A shows, in greater detail, the ignition antenna of the unit in accordance with the invention.
Figure 2B:
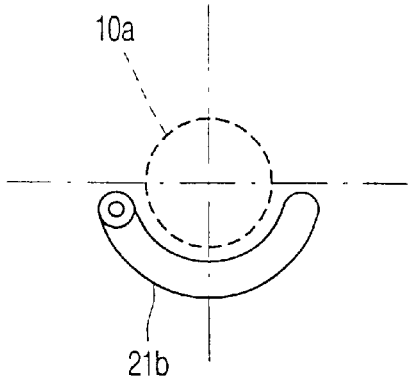
FIG. 2B is a cross-sectional view taken on the line II—II in FIG. 2A of the ignition antenna.

The ignition antenna 2 is shown in greater detail in FIGS. 2A and 2B. These Figures also show, by means of broken lines, portions 10*a*, 10*c*, of the lamp vessel 10. The ignition antenna 2 comprises a gastight antenna vessel 20, which is provided with an ionizable filling, in this case argon at a filling pressure of 100 mbar. In another embodiment, the ionizable filling additionally comprises, for example, 0.5 mg mercury. The ignition antenna 2 further comprises an additional outer electrode 22, which is connected to the further current conductor 24. The antenna vessel 20 of the ignition antenna 2 is a quartz glass tube. The electrode 22 is provided at an outside surface of the antenna vessel. In this case, the electrode 22 is embodied so as to be a metal bush 22*a* which is clamped onto the free end portion 21*a*′ of the elongated portion 21*a* of the antenna vessel 20 by means of an inwardly resilient lug 22*a*′. The bush 22*a* is capacitively coupled to the ionizable filling in the antenna vessel 20. An even better capacitive coupling is obtained in that the free end portion 21*a*′ is provided with a coating 22*b* of a metal, in this case platinum. The tube comprises a first, comparatively wide, elongated portion 21*a* having a length of 25 mm and an internal diameter of 0.6 mm and a wall thickness of 0.45 mm, which portion extends along the neck-shaped end portion 10*a*. The tube comprises a second, comparatively narrow portion 21*b* with an internal diameter of 0.6 mm, which second portion is situated near the central portion 10*c* and bent around the neck-shaped end portion 10*a*. In this case, the second portion 21*b* describes a 180° curve around the end portion 10*a*. The antenna vessel 20 of the ignition antenna 2 encloses an electroconductive element 23 in the form of a metal foil, for example Mo foil. The further electrode 22 extends along the elongated portion 21*a* of the antenna vessel 20. The electroconductive element 23 extends at least 2 mm beyond the further electrode.

The unit shown in FIG. 1 further comprises a reflector 30. The reflector 30 is convergent and comprises an optical axis 31, a light emission opening 32 and a further opening 33 opposite said light emission opening. In this case, the reflector is a parabolic reflector. The reflector 30 surrounds the central portion 10*c* of the lamp vessel 10. One of the end portions, in this case 10*a*, issues to the exterior through the further opening 33 of the reflector 30.

The unit shown additionally comprises, in this case, voltage-transforming means 40. The current conductors 12*a*, 12*b* are each connected to an input 41*a*, 41*b*, respectively, of the voltage-transforming means 40, and the further current supply conductor 24 is connected to an output 42 of the voltage-transforming means. In this case, the voltage-transforming means 40 are embodied so as to be an inductively operating transformer. In an alternative embodiment of the unit in accordance with the invention, which embodiment is not shown, the further current supply conductor 24 is connected to a separate input, to which, for example, ignition-voltage pulses can be applied, while a constant supply voltage is applied to the inputs 41*a*, 41*b* of the current conductors 12*a*, 12*b*, respectively.

The ignition time of a unit in accordance with the invention has been examined. Also the ignition time of a unit in accordance with WO 99/48133 has been examined.

Both the unit in accordance with the invention and the unit in accordance with WO 99/48133 are placed in a dark room. After a period of 24 hours, the proper current conductors of the first and the second electrode of each unit are connected to a voltage source of 300 V, the dark-room conditions being maintained, and the further current supply conductor for supplying current to the antenna vessel is connected to a 9 kV sinusoidal ignition voltage. In a series of tests, the antenna vessel contains Ar as the filling having a filling pressure of 100 mbar. In the case of the unit in accordance with the invention, ignition of the lamp takes place substantially instantaneously, but in all cases at least within 20 seconds. In the case of the unit in accordance with WO 99/48133, a substantial ignition delay occurs which may even amount to more than one minute. If, in the case of an ignition delay >50 s, the unit is exposed to UV light from a separate UV source, then instantaneous ionization takes place in the antenna vessel, followed by breakdown in the lamp.

For use in a projection system, such as a projection television, an ignition with a delay of 50 s is just acceptable. However, the ignition delay preferably is <20 s.

The invention is further embodied in each novel characteristic and each combination of characteristics.

What is claimed is:

1. A unit comprising a high-pressure discharge lamp (1) and an ignition antenna (2), which high-pressure discharge lamp is provided with a light-transmitting, gastight lamp vessel (10) containing an ionizable filling, in which lamp vessel a first and a second electrode (11*a*, 11*b*) are arranged, and each one of the electrodes is connected to a current conductor (12*a*, 12*b*) of its own, which issues from the lamp vessel to the exterior, which ignition antenna (2), which is arranged near the lamp vessel, is provided with a gastight antenna vessel (20) which contains an ionizable filling and which is provided with a further outer electrode (22), which is provided on an outside surface of the antenna vessel (20) and connected to a further current supply conductor (24), characterized in that the antenna vessel of the ignition antenna also encloses an electroconductive element.

2. A unit as claimed in claim 1, characterized in that the antenna vessel (10) is made from a translucent material.

3. A unit as claimed in claim 1, characterized in that the ignition antenna (2) generates UV radiation in an activated state.

4. A unit as claimed in claim 1, characterized in that the electroconductive element is situated inside the antenna vessel at the location of the further electrode.

5. A unit as claimed in claim 1, which is further characterized in that the electroconductive element is formed by a metal foil.

6. A unit as claimed in claim 4, characterized in that the antenna vessel comprises an elongated part along which the further electrode extends, and in that the electroconductive element extends at least 2 mm beyond the further electrode.

7. A unit as claimed in claim 1, characterized in that the lamp vessel (10) comprises a comparatively wide central portion (10*c*) and, on either side thereof, neck-shaped end portions (10*a*, 10*b*), the electrodes (11*a*, 11*b*) being arranged in the central portion of the lamp vessel, and the current conductors (12*a*, 12*b*) each extending through a respective end portion, and the antenna vessel (20) of the ignition antenna (2) being a tube which, near the central portion, is bent around one (10*a*) of the end portions.

8. A unit as claimed in claim 1, which is further characterized by a reflector (30).

9. A unit as claimed in claim 8, characterized in that the reflector (30) is a converging reflector (30) having an optical axis (31), a light emission opening (32) and a further opening (33) opposite said light emission opening, the reflector surrounding the central portion (10*c*) of the lamp vessel (10), the neck-shaped portions (10*a*, 10*b*) of the lamp vessel extending along the optical axis, and the end portion (10*a*), around which the antenna vessel (20) of the ignition antenna (2) is bent, issuing to the exterior through said further opening.

* * * * *